US005257793A

United States Patent [19]

Fortin

[11] Patent Number: 5,257,793

[45] Date of Patent: Nov. 2, 1993

[54] SKATE WITH ADJUSTABLE RUNNER

[76] Inventor: Pierre Fortin, 4314 Alain, Pierrefonds, Quebec, Canada, H9H 2R6

[21] Appl. No.: 822,977

[22] Filed: Jan. 21, 1992

[51] Int. Cl.[5] ..... A63C 1/30

[52] U.S. Cl. ..... 280/7.13; 280/11.12; 280/11.16; 280/11.22

[58] Field of Search ..... 280/11.18, 11.17, 11.16, 280/11.15, 11.12, 11.27, 11.22, 7.13, 7.14

[56] References Cited

U.S. PATENT DOCUMENTS

| | | | |
|---|---|---|---|
| 36,244 | 8/1862 | Starr | 280/11.12 |
| 601,013 | 3/1898 | Evans | 280/11.18 |
| 1,097,875 | 5/1914 | Pierce | 280/11.16 |
| 2,188,971 | 2/1940 | Adonzio | 280/11.17 |
| 4,085,944 | 4/1978 | Chambers | 280/11.12 |
| 4,108,450 | 8/1978 | Cote | 280/11.22 |
| 4,139,209 | 2/1979 | Humphreys | 280/11.2 |

FOREIGN PATENT DOCUMENTS

| | | | |
|---|---|---|---|
| 8800917 | 8/1988 | Netherlands | 280/11.16 |
| 8702068 | 4/1989 | Netherlands | 280/11.18 |

*Primary Examiner*—David M. Mitchell

[57] ABSTRACT

A skate in which the runner, such as an ice skate blade mounted in a support member, is hingedly connected at the front end thereof to a support member mounted at the sole plate in the toe area of the boot. A retractable and expandable telescopic member is provided at the rear of the skate including a stub shaft fixedly mounted to a heel plate to which a threaded cylinder is rotatably mounted and engages a threaded pedestal extending upwardly from the support member, and rotation of the threaded cylinder will cause retraction or contraction of the support and the blade securely mounted in the support about the rotation about the pivot pin extending through the front of the boot.

5 Claims, 4 Drawing Sheets

10
12
20
33
32
22
24
18
16
14
44
34
3
3
28
40
42
26
38
30
36
I
I
I 10
12
22
32
24
20
18
14
34
40
16
26
42
44
28
30
38
36
I
I 48
50
52
54
58
56
58
58
68
60
62
60
64
1
2
3
4

SKATE WITH ADJUSTABLE RUNNER

BACKGROUND OF THE INVENTION

1. Field of the Invention

The present invention relates to skates, and more particularly, to a skate having a boot and a runner attached to the sole of the boot.

2. Description of the Prior Art

Ice skates, and recently a dry land skate known typically under the trade-mark "Rollerblade," generally have a boot with a sole, a support for mounting the runner, and the runner, which in the former is an ice skate blade and in the latter a series of longitudinally aligned wheels. Other types of skates exist, such as roller skates, which are well known. There are different categories of ice skates, such as hockey skates, figure skates, and racing skates. Conventional figure skates do not have a runner support per se, but the blade, being thicker, is stamped in one piece and includes struts to be welded to a sole and heel plate, which in turn are connected to the sole of the boot.

The other skates mentioned above generally have a support structure separable from the runner. In the case of ice hockey skates, the support is made of molded plastics material with a kerf along the bottom edge for receiving the metal blade and a front and rear pedestal for attachment to the boot sole. Racing skates and some models of hockey skates have a support made of sheet metal formed into tubes with a separate blade secured by the support.

It has been known, at least in ice hockey skates, to adjust the contour of the ice contact edge of the blade to comply to the preferred location of the center of gravity of the player. For instance, the center of gravity of a player can be shifted forward or rearward by adjusting the angle of the edge of the blade relative to the axis of the player's body.

By reducing the angle, the center of gravity of the player is shifted forwardly. This can be done by grinding the skate blade so that the edge of the blade converges with the sole of the boot from the rear to the front of the skate. When a player wears the skate boot and stands on the blades which have been so ground, his body will tend to lean forward. If it is desired to shift the center of gravity rearwardly, the skate blade will be ground in the opposite direction, that is, to increase the angle and, therefore, make the edge of the blade converge with the sole of the boot, from the front to the rear of the skate.

In hockey, it has been found that a forward or "offense" player will want to have the angle of the blade reduced so as to shift the center of gravity forward. This is an important feature since the boots are anatomical, and the maximum limit that the ankle can flex for a player is roughly 40 to 45°. By grinding or somehow changing the angle of the blade edge, this angle can be further reduced relative to the ice surface giving the "offense" player greater advantage when accelerating and enabling him to maintain a higher speed on the ice.

A "defense" player, on the other hand, must be able to skate back either by turning around 180° or by skating in a rearward direction. The defense player in a hockey game will want to keep his center of gravity closer to the vertical axis. Thus, the defense player may wish to alter the angle of the blade so that it converges rearwardly or is at least flat, that is, parallel with the sole of the boot. In any event, it has been found that at least professional hockey players will grind their blades to suit the angle which is more natural to them.

There have been attempts to incorporate such a feature in ice skates, and reference is made to U.S. Pat. No. 4,139,209, issued Feb. 13, 1979 to Donald R. Humphreys. The Humphreys patent proposes the adjustment of the skate blade relative to the support. The skate blade in Humphreys is pivoted near the rear of the support within the kerf while adjustment screws are provided near the front of the support for varying the angle of the blade relative to the support. One of the disadvantages with this configuration is that there are only two structural contacts between the blade and the support or carrier in the vertical plane, that is, at the pivot and at the adjustment point near the front of the blade. Furthermore, as the blade is rotated counterclockwise, that is, to diverge in the front from the support, more and more of the blade is exposed reducing the lateral structural support of the carrier or support and the blade.

The purpose of the support or carrier is to provide, in the lateral direction, a structural triangular support for the blade, as shown in the drawings of the Humphreys patent. However, as the blade extends further downwardly from the support, that structural support rendered by the carrier is diminished. When the blade is retracted into the support, the side walls of the support can interfere with the blade in the sense that the lateral angle to which a player may expect to lean without having the blade lose contact with the ice will be reduced, which can cause the player to slip as the side wall of the support comes into contact with the ice surface.

SUMMARY OF THE INVENTION

It is an aim of the present invention to provide a skate having a runner and runner support which may be adjusted to change the angle of the contact surface with the ground, relative to the upright axis of the skater.

It is a further aim of the present invention to provide an improved hockey skate compared with the prior art.

It is a still further aim of the present invention to provide a hockey skate wherein the blade and support may be subject to angular adjustment relative to the sole of the boot.

A construction in accordance with the present invention comprises a skate having a skate boot with a boot sole having a toe portion, a metatarsal portion, and a heel portion, and a runner including a runner support. A first support mounting member is provided on the toe portion of the sole, and a second support mounting member is provided at the heel portion of the sole. The runner support is hingedly mounted to the first support mounting member about a lateral axis relative to the longitudinal axis of the boot. A telescopic connecting member extends between the runner support and the second support mounting member whereby adjustment to the telescopic member to retract or extend the member will cause the support and runner to pivot in unison about the lateral pivot axis at the first support mounting member to change the angle between the ground engaging surface of the runner and the axis of the skater.

More specifically, the skate of the present invention is a hockey skate with an ice engaging blade securely mounted in an elongated support.

In a more specific embodiment, a telescopic member extending between the second support mounting member and the runner support is a threaded first member engaged by a threaded female member which, upon adjustment of the threaded female member, causes the threaded first member to extend or retract therefrom.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENT

Figure 1:
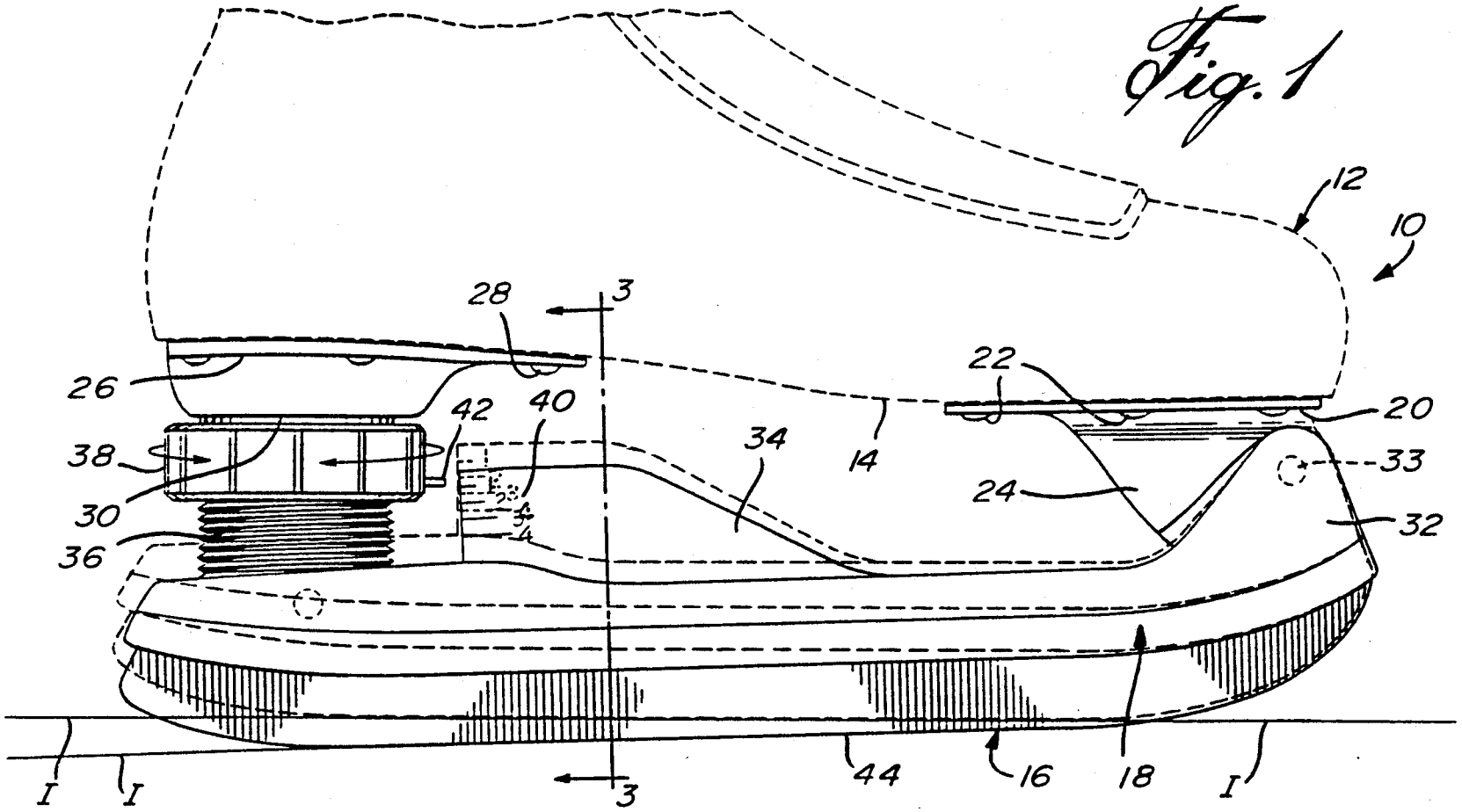
FIG. 1 is a side elevation, partly in dotted lines, showing a hockey skate in accordance with the present invention.
Figure 2:
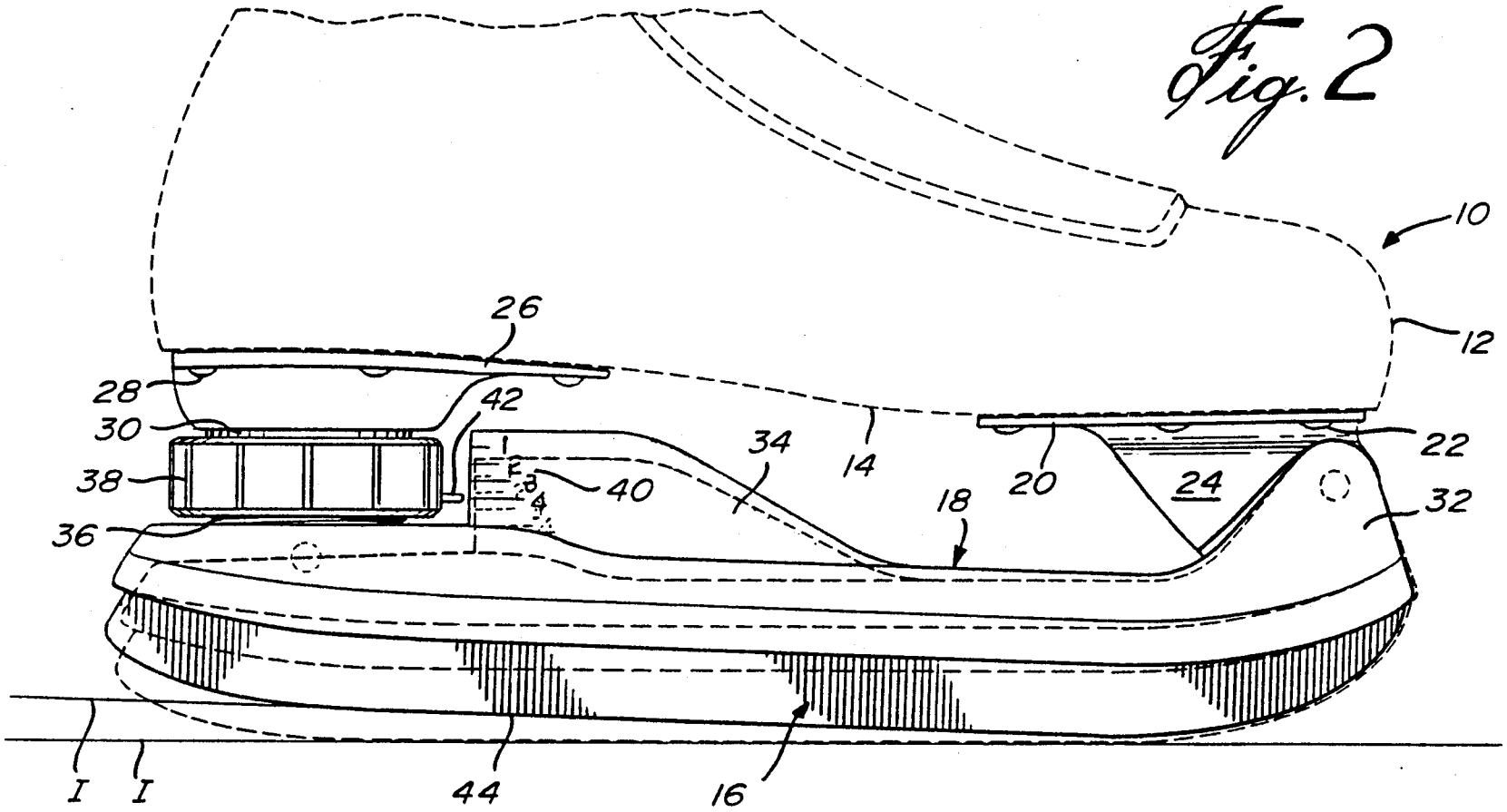
FIG. 2 is a side elevation of a hockey skate similar to FIG. 1 but showing the skate in a different operating position.
Figure 3:
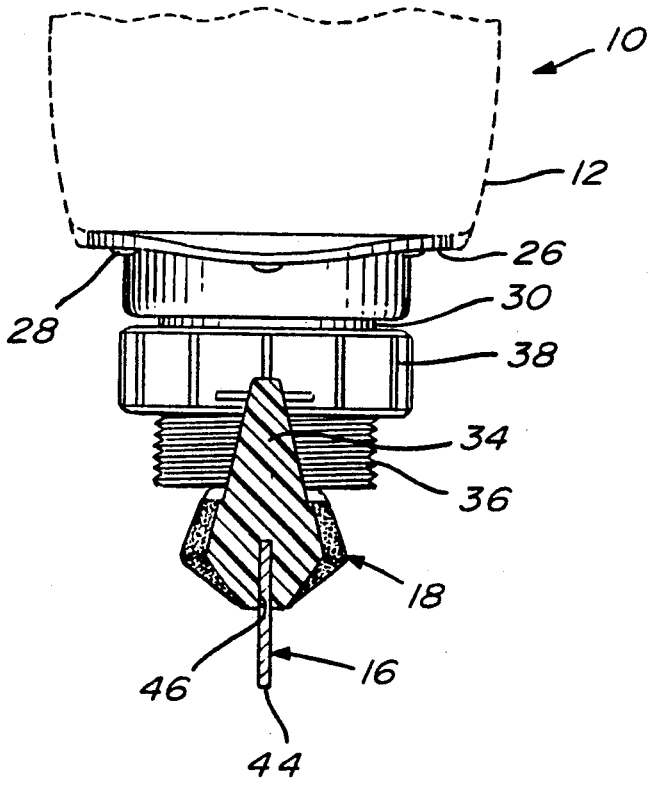
FIG. 3 is a fragmentary vertical cross-section taken along line 3—3 of FIG. 1.

Referring now to the drawings and in particular to FIGS. 1, 2, and 3, there is shown a hockey skate 10 having a boot 12 shown partly in dotted lines. The boot has a sole 14. The runner in this case is an ice blade 16 securely mounted in a molded plastics support member 18.

The boot has a toe area, a metatarsal area, and a rear heel area. A sole plate 20 is fixed to the sole 14 in the toe area by means of rivets 22. A mounting plate 24 extends downwardly from the sole plate 20 and is in a plane which is within the longitudinal axis of the boot 12. A heel plate 26 is similarly mounted by means of rivets 28 to the heel portion of the sole 14. A short stub shaft 30 extends downwardly from the heel plate 26.

It is understood that the sole plate 20 and heel plate 26 may be molded in one piece with the sole and upper of the boot, in the event that the boot is a molded plastics boot.

The molded plastics support 18 includes, at the front end thereof, a U-shaped bracket 32 which is pivotally mounted to the mounting plate 24 by means of a pivot pin 33. This allows the support and, therefore, the runner, to rotate about a lateral axis extending through pin 33. On the rear of the runner support 18, there is an upstanding threaded pedestal 36. The threaded pedestal 36 is engaged by a threaded cylinder 38 which is mounted for rotation on the stub shaft 30.

As can be seen, the rotation of the threaded cylinder 38 on the pedestal 36 will cause the pedestal 36 to either retract into the cylinder 38 or to extend therefrom.

Also integral with the support 18 is an upstanding web 34 to which is provided a scale 40. A small indicator pin 42 is mounted on the cylinder 38, and as the cylinder 38 is rotated, the indicator 42 will coincide with indicia on the scale 40 to indicate the level of angularity of the runner relative to the sole 14 of the boot.

It is important to be able to adjust the angle of the runner or, in this embodiment, the blade 16 relative to the upright axis of the player. If the player is a forward or an "offense" player, his main requirement is acceleration and speed and, therefore, he will be in a better position if he is leaning forward and thus with a center of gravity forward of the skates. Since the player's anatomy limits the amount of flexing at the ankle to between 40 and 45°, the adjustment of the angle of the skate blade edge 44 to the angle of the average axis running through the player's body will be important. For instance, by pivoting the blade 16 counterclockwise relative to the pivot 33 by rotating the threaded cylinder 38 to extend the pedestal 36 therefrom, the angle of blade 16 relative to the axis of the player will be decreased thereby allowing the player to lean still further forward.

If the hockey player is a "defense" player, it is preferable that his center of gravity be over the blades 16 and thus the angle between the blades 16 and the axis of the player should be increased. This can be accomplished by rotating the threaded cylinder 38 to thereby retract the threaded pedestal 36 and thus rotate the blade 16 clockwise about the pivot pin 33 thereby increasing the angle between the blade 16 and the axis of the player. This is as shown in FIG. 2.

It is important to note that the structure of the present hockey skate does not depend on extending the blade from the skate support 18, but the blade support 18 and the blade 16 are moved as one piece about the lateral axis through the pin 33.

Figure 4:
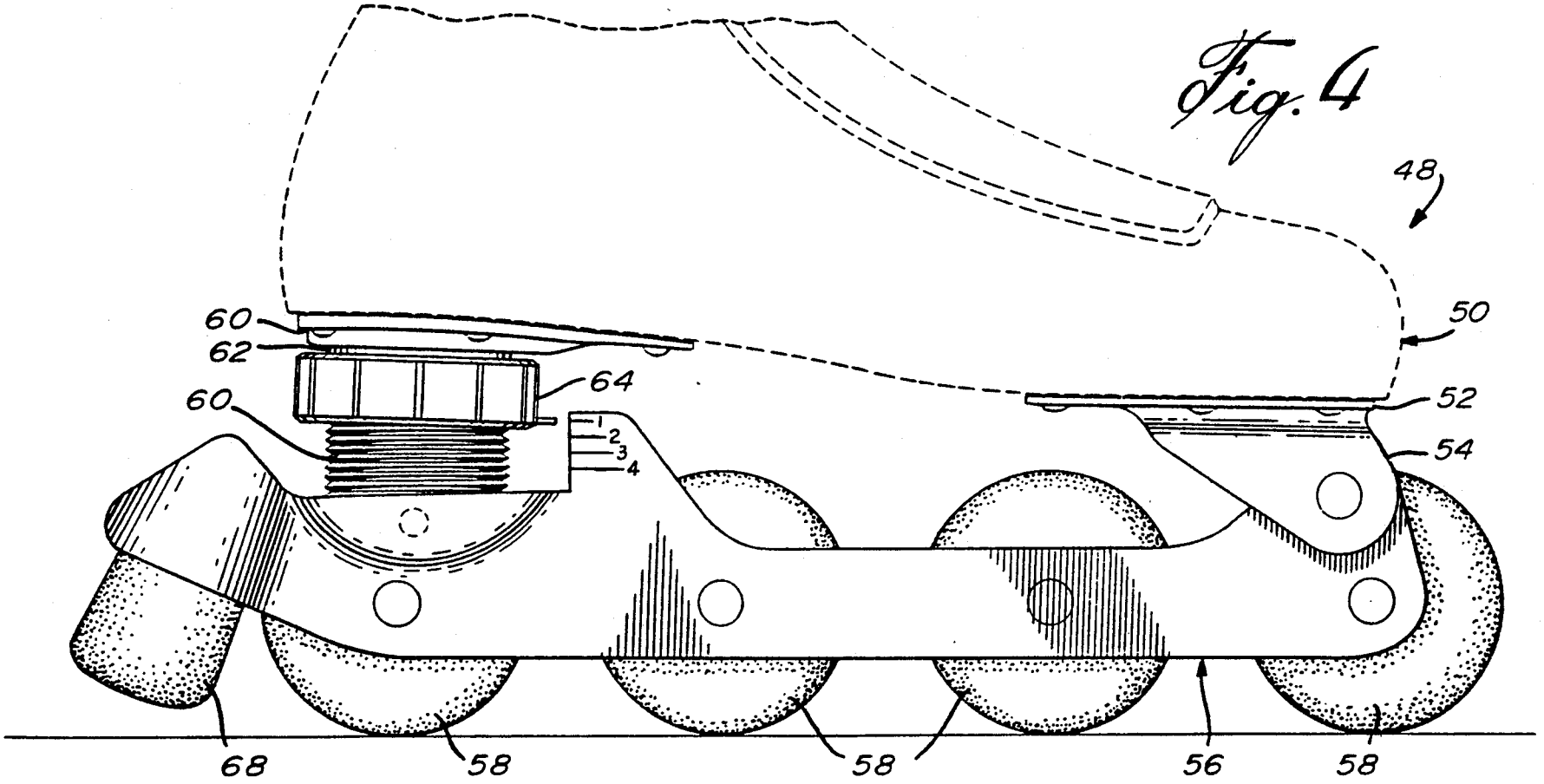
FIG. 4 is a fragmentary side elevation of a different embodiment of the present invention.

The present invention can be applied to other types of skates, and an example is shown in FIG. 4 where a "Rollerblade" (a trade-mark) type skate 48 is illustrated. The skate 48 has a boot 50 with a sole plate 52, including a U-shaped bracket 54 on the front of the boot 50. The runner includes a support 36 to which are mounted a series of wheels 58 in line. A heel plate 60 is mounted to the rear of the boot 50 and includes a stub shaft 62 to which a threaded cylinder 64 is mounted for rotation and engages the threaded pedestals 66 to retract or extend the runner 56.

It can be contemplated that similar skates, such as speed skating skates or even roller skates, can benefit from the structure of the present invention as described above.

I claim:

1. A skate having a skate boot with a boot sole having a toe portion, a metatarsal portion, and a heel portion, a runner including a runner support, a first support mounting member on the toe portion of the sole and a second support mounting member at the heel portion of the sole, the runner support and the first support mounting member having a hinge connection with an axis of rotation extending laterally to the runner and including a fixed plate and a U-shaped bracket with a pivot pin such that the first support rotates about the lateral axis but is constant in height, an extension-retraction connecting member between the runner support and the second support mounting member including a first threaded pedestal member mounted to the runner support and a threaded cylindrical member rotatably mounted to the second support mounting member such that rotation of the threaded cylindrical member will cause the retraction or extension of the threaded pedestal, whereby adjustment of the connecting member to retract or extend the connecting member will cause adjustment of the angle of the runner and the runner support relative to the boot about the lateral axis passing through the pivot pin on the first support mounting member.

2. A skate as defined in claim 1, wherein the cylindrical member is provided with a cursor and the runner support includes a projection adjacent the cylindrical member and a scale with indicia is provided on the projection such that the cursor on the cylindrical member will indicate the degree of angle of adjustment between the runner and the skate boot in respect of the pivot pin at the first support mounting member.

3. A skate as defined in claim 1, wherein the runner is in the form of an ice skate blade securely mounted in the support.

4. A skate as defined in claim 3, wherein the skate is a hockey skate with an ice hockey skate blade securely mounted in a molded plastics runner.

5. A skate as defined in claim 1, wherein the runner includes a series of in-line wheels each rotatably mounted on the support.

* * * * *